US005655501A

United States Patent [19]

Hafner

[11] Patent Number: 5,655,501

[45] Date of Patent: Aug. 12, 1997

[54] RATE SHAPING PLUNGER/PISTON ASSEMBLY FOR A HYDRAULICALLY ACTUATED FUEL INJECTOR

[75] Inventor: Gregory G. Hafner, Normal, Ill.

[73] Assignee: Caterpillar Inc., Peoria, Ill.

[21] Appl. No.: 644,023

[22] Filed: May 9, 1996

[51] Int. Cl.[6] ..... F02M 37/04

[52] U.S. Cl. ..... 123/496; 123/501

[58] Field of Search ..... 123/299, 300, 123/446, 447, 496, 501

[56] References Cited

U.S. PATENT DOCUMENTS

| | | | |
|---|---|---|---|
| 2,179,354 | 11/1939 | Scott . | |
| 3,614,944 | 10/1971 | Ulbing . | |
| 3,965,875 | 6/1976 | Perr . | |
| 4,718,384 | 1/1988 | Takahashi | 123/447 |
| 5,033,442 | 7/1991 | Perr et al. | 123/501 |
| 5,072,709 | 12/1991 | Long et al. | 123/501 |
| 5,076,240 | 12/1991 | Perr | 123/501 |
| 5,143,291 | 9/1992 | Grinsteiner | 123/446 |
| 5,333,786 | 8/1994 | Gant et al. | 123/501 |
| 5,413,076 | 5/1995 | Koenigswieser et al. | 123/446 |
| 5,526,792 | 6/1996 | Guth et al. | 123/496 |

FOREIGN PATENT DOCUMENTS

| | | |
|---|---|---|
| 323591A | 7/1989 | European Pat. Off. . |
| 33489 | 8/1934 | Netherlands . |

*Primary Examiner*—Thomas N. Moulis
*Attorney, Agent, or Firm*—Liell & McNeil

[57] ABSTRACT

In hydraulically actuated fuel injectors, an intensifier piston is utilized with a plunger for raising fuel pressure to initiate an injection event with a VOP type fuel injector. The present invention lowers the mass flow rate of fuel at the beginning of each injection event by slowing the rate of the plunger relative to the intensifier piston by utilizing a spring to separate the two. As the spring compresses, energy from the high pressure actuation fluid is absorbed rather than transferred to raise fuel pressure. A short time into each injection event, the spring becomes fully compressed and the intensifier piston and plunger begin moving in rigid unison for the remaining of the injection event in a manner typical of prior art fuel injectors. The lowering of injection mass flow rate toward the beginning of each injection event results in improved engine performance and a lowering of undesirable exhaust emissions, especially NOx compounds.

9 Claims, 4 Drawing Sheets

RATE SHAPING PLUNGER/PISTON ASSEMBLY FOR A HYDRAULICALLY ACTUATED FUEL INJECTOR

TECHNICAL FIELD

The present invention relates generally to hydraulically actuated fuel injection systems, and more particularly to a plunger/piston assembly for a hydraulically actuated fuel injector having the ability to rate shape the injection mass flow rate at the beginning portion of each injection event.

BACKGROUND ART

It is well known that a device that reduces the rate of fuel injection mass flow at the beginning of each injection event will help reduce undesirable NOx emissions in the combustion exhaust from a diesel engine. In addition, fuel injection rate shaping at the beginning of each injection event, or what is sometimes commonly referred to in the art as "pilot or pre-injection", can improve the combustion efficiency of the engine. In the case of a hydraulically actuated fuel injection system, an intensifier piston is acted upon by a high pressure actuation fluid, such as lubricating oil. The intensifier piston in turn drives a plunger to raise fuel pressure within a pressurization chamber above a threshold level that opens the needle check and allows fuel to exit the nozzle outlet of the injector. In most such prior art fuel injectors, the piston/plunger assembly is specifically designed to act as a single rigid unit. Because the injection mass flow rate is strongly related to the movement rate of the plunger. The rigid contact between the intensifier piston and the plunger renders it impossible to alter plunger movement rate independent from the intensifier piston.

While there exists a myriad of techniques for introducing rate shaping into an injector of this type, many of these techniques suffer from drawbacks rendering them unsuitable or otherwise impractical.

The present invention is directed to introducing some rate shaping into such an injector by permitting relative movement between the piston and plunger at the beginning of each injection event.

DISCLOSURE OF THE INVENTION

The present invention introduces rate shaping by including a compression spring positioned between the intensifier piston and plunger of a hydraulically actuated fuel injector. The spring serves to bias the piston a distance away from the plunger before each injection event commences. The preload or assembled load of the spring is preferably set such that pressure within the fuel pressurization chamber reaches a level sufficient to open the needle check of the injector before the rate shaping spring begins to yield. The rate shaping spring delays when the injector achieves maximum fuel mass flow rate relative to an equivalent prior art injector. This delay at the beginning of each injection event causes a corresponding lower amount of fuel to be injected at the beginning of each injection event, hence producing a more desirable fuel injection rate shape that improves engine performance and reduces undesirable emissions.

One object of the present invention is to introduce some rate shaping in a hydraulically actuated fuel injector.

Another object of the present invention is to improve combustion efficiency and lower undesirable emissions from an engine using a hydraulically actuated fuel injector.

BEST MODE FOR CARRYING OUT THE INVENTION

Figure 1:
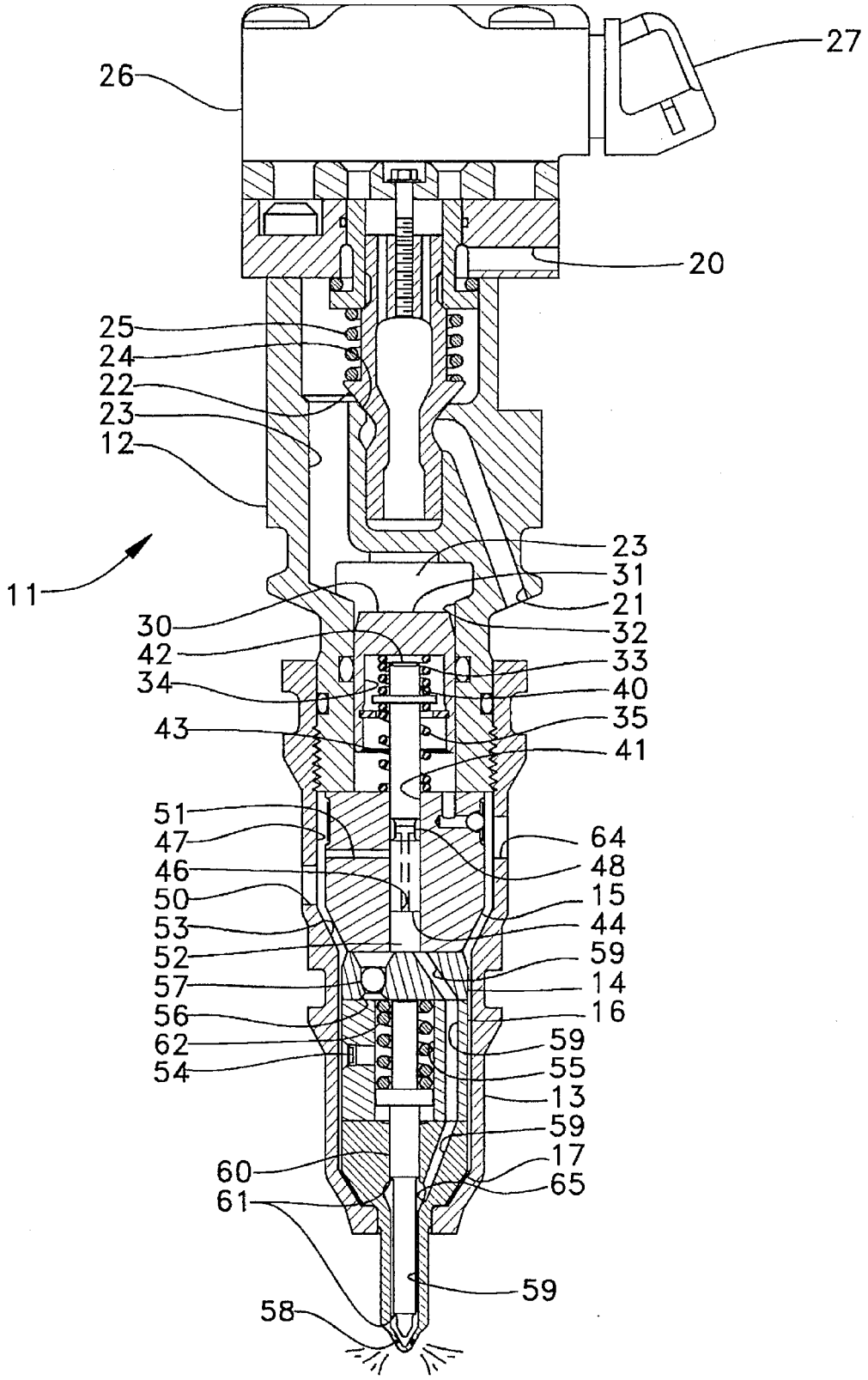
FIG. 1 is a side sectioned elevational view of a hydraulically actuated fuel injector according to the preferred embodiment of the present invention.

Referring now to FIG. 1, each unit injector 11 according to the present invention includes an injector body made up of an upper body portion 12, a lower body portion 13, and a series of inner block portions 14–17. Injector body 12–17 includes an actuation fluid cavity 23 that opens to an actuation fluid inlet 21, an actuation fluid drain 20, and a piston bore 32. The injector body also includes a plunger bore 41 that opens to a nozzle supply bore 59 and a fuel supply passage 56. Also included in the injector body is a nozzle chamber 65 that opens to nozzle supply passage 59 and a nozzle outlet 58.

A control valve 22 is mounted within the injector body and is moveable by a solenoid 26. Valve 22 has a first position that opens the actuation fluid inlet 21 and closes actuation fluid drain 20, and a second position that closes actuation fluid inlet 21 and opens drain 20. FIG. 1 shows control valve 22 in its first position. It should be noted, however, that because the control valve 22 moves on the order of about 250 microns between its first position and its second position, the position of control valve 22 cannot readily be ascertained from a drawing of the type shown in FIG. 1 without examining the relative positions of the other components of fuel injector 11. It should also be noted that, although control valve 22 is shown as a poppet type two-way valve, a three-way spool valve could also be utilized in an injector of this type. In such a case, the control valve would have a third position in which both the actuation fluid inlet 21 and the actuation fluid drain 20 are both closed. This alternative is especially useful in some fill metering applications.

When solenoid 26 receives its actuation signal (electric current) via connection point 27, poppet valve 22 is lifted off of seat 24 against the action of control valve return spring 25 and moved to its first position. This allows high pressure actuation fluid to flow through inlet 21 into actuation fluid cavity 23. At the same time, actuation fluid drain 20 is closed by poppet valve 22 when it reaches its upper stop. When solenoid 26 is deactivated, valve return spring 25 moves poppet valve 22 back to its seat 24 to close actuation fluid inlet 21. Each injection event is initiated by activating solenoid 26.

An intensifier piston 30 is positioned to reciprocate within piston bore 32 between a lower position and an upper position. Piston 30 is shown in FIG. 1 between these positions on its downward stroke. As is known in the art, intensifier piston 30 acts under the force of actuation fluid pressure within actuation fluid cavity 23 and serves as a means for increasing the downward force on plunger 40. Although intensifier piston 30 includes a lower area exposed to cavity 34, the piston includes only a single hydraulic actuation surface 31 which is exposed to actuation fluid cavity 23. In other words, the vapor pressure within volume 34 is negligible compared to the forces acting on intensifier piston by plunger 40, rate shaping spring 33, return spring 35 and the pressure within actuation fluid cavity 23. Unlike the prior art, rate shaping spring 33 of the present invention biases plunger 40 away from piston 30 over certain portions of each injector cycle.

A plunger 40, having a side surface 43 extending between a contact end 42 and a pressure face and 44, is capable of reciprocating within plunger bore 41 between an advanced position and a retracted position. Plunger 40 is shown during its downward stroke. Contact end 42 of plunger 40 is intended to come in contact with the underside of intensifier piston 30 when plunger 40 is moving from its retracted position toward its advanced position on its downward stroke during an injection event. Plunger 40 also includes a pressure relief passage 46 that opens on one end through pressure face 44 and opens on its other end through side surface 43 via annulus 48. Although not necessary, this aspect of the invention is desired because of its ability to provide an abrupt end to injection by permitting residual fuel pressure at the end of each injection event to be quickly dissipated by exposure to the low pressure within fuel drain passage 64 via fuel return passage 51.

Pressure face end 44 of plunger 40 and a portion of plunger bore 41 define a fuel pressurization chamber 52 that opens to nozzle supply bore 59 and a fuel supply passage 56. Although it would be desirable to merge the fuel pressurization chamber and the nozzle chamber into a single chamber, fuel pressurization chamber 52 is in fluid communication with the nozzle chamber 65 via nozzle supply bore 59. A check valve 57 in fuel supply passage 56 prevents fuel from flowing backward into fuel supply passage 56 from fuel pressurization chamber 52.

A needle check 60 is positioned to reciprocate in nozzle chamber 65 between a closed position that closes nozzle outlet 58 and an open position as shown that opens the nozzle outlet. Needle check 60 includes hydraulic lift surfaces 61 that are exposed to the fuel pressure within nozzle chamber 65. A check return spring 62 serves as the means by which needle check 60 is biased toward its closed position. Needle check 60 opens nozzle outlet 58 during each injection event when fuel pressure within nozzle chamber 65 (and fuel pressurization chamber 52) acting on hydraulic surface 61 is sufficient to overcome check return spring 62.

Fuel enters injector 11 at fuel inlet 50. The fuel then flows down through fuel supply passage 53 through filters 54 (either screen or edge filters are preferred) through the chamber holding check return spring 62, up into fuel supply passage 56, past check 57 and eventually into fuel pressurization chamber 52. Check valve 57 prevents reverse flow of fuel. Fuel is free to circulate between fuel inlet 50 and fuel drain 64 such that a plurality of injectors can have their fuel supplies connected in series, in a manner known in the art. Injector 11 is shown during an injection event with actuation fluid inlet 20 open, plunger 40 and piston 30 moving downward, and nozzle outlet 58 open.

Before introducing the rate shaping concept of the present invention, it will be useful to those skilled in the art to briefly review the overall functioning of injector 11. Although the present invention is illustrated for use preferably with a fill metered type hydraulically actuated electronically controlled fuel injector, those skilled in the art will appreciate that the concept of the present invention could be applied to any hydraulically actuated fuel injector. Before each injection event begins, solenoid 26 is de-energized to close actuation fluid cavity 23 to the high pressure actuation fluid inlet 21. At this time, piston 30 and plunger 40 are retracting under the action of return spring 35 as fuel flows into fuel pressurization chamber 52. Needle check 60 is in its closed position. Actuation fluid cavity 23 continues to drain out into low pressure drain 20.

The next injection event is then initiated by energizing solenoid 26 so that control valve member 22 lifts off its lower seated position against the action of return spring 25. This initiating event is preferably commanded when a desired amount of fuel has metered into the injector. This action simultaneously opens high pressure actuation fluid inlet 21 and closes low pressure drain 20 to actuation fluid cavity 23. As pressure builds within actuation fluid cavity 23, plunger 40 and piston 30 momentarily stop retracting and then reverse direction and begin a downward movement. Downward movement of plunger 40 in turn raises fuel pressure within fuel pressurization chamber 52. At a threshold valve opening pressure, needle check 60 opens against the action of check return spring 55 to allow fuel to exit nozzle outlet 58. The injection event continues until annulus 48 on plunger 40 opens to fuel spill passageway 51. This event typically occurs when the plunger has reached the end of its stroke.

Each injection event is abruptly terminated when the residual high pressure fuel in fuel pressurization chamber 52 is vented through pressure relief passage 46 and the fuel spill passage 51, which are connected via annulus 48. This in turn causes pressure within nozzle chamber 65 to drop rapidly below the valve opening pressure necessary to hold needle check 60 open. Needle check 60 then begins to close under the action of return spring 55. At this time relatively small amounts of fuel are allowed to leave nozzle outlet 58 because the fuel pressure within nozzle chamber 65 is relatively low and the needle check itself is quickly moving toward a closed position.

After the injection event has ended by the closure of nozzle outlet 58, the injector enters a standby mode. During the standby mode, piston 30 and plunger 40 rest at the bottom of their stroke under the action of high pressure actuation fluid in cavity 23. (See FIG. 2) The duration of the standby mode is determined by the amount of fuel to be metered into the injector for the next injection event as well as the timing of the next injection event. The standby mode is ended, and the fill metering mode of the injector cycle commences, with the de-energization of solenoid 26 to move control valve 22 to close actuation fluid inlet 21 and open actuation fluid drain 20. The pressure within cavity 23 drops relatively instantaneously and actuation fluid begins to drain through outlet 20 as piston 30 and plunger 40 begin to retract under the action of return spring 35. The solenoid is kept de-energized for only as long as it takes for the desired amount of fuel for the next injection event to be metered into fuel pressurization chamber 52. The metering mode is ended and the next injection event is initiated by again energizing solenoid 26 to reopen high pressure fluid inlet 21. Thus, each injector cycle in this preferred embodiment includes an injection mode, a standby mode and a metering mode.

The present invention is primarily concerned with the beginning portion of each injection mode, which means the time period after the nozzle outlet is opened but before mass flow out of the nozzle outlet has peaked. It has been found that if the duration of this ramping-up portion of the injection mode is enlarged, less fuel is injected into the combustion chamber of the engine at the beginning of each injection event. This causes a decrease in harmful NOx emissions and an increase in engine performance. The duration of this pre-injection portion of each injection event could not easily be enlarged in prior art devices because the movement rate of the plunger could not be independently varied from that of the piston due to their rigid connection or contact. The present invention enlarges the duration of pre-injection mass flow by separating the plunger from the piston and inserting a spring therebetween. This results in the plunger moving slower than the piston over a portion of its downward stroke.

Figure 2:
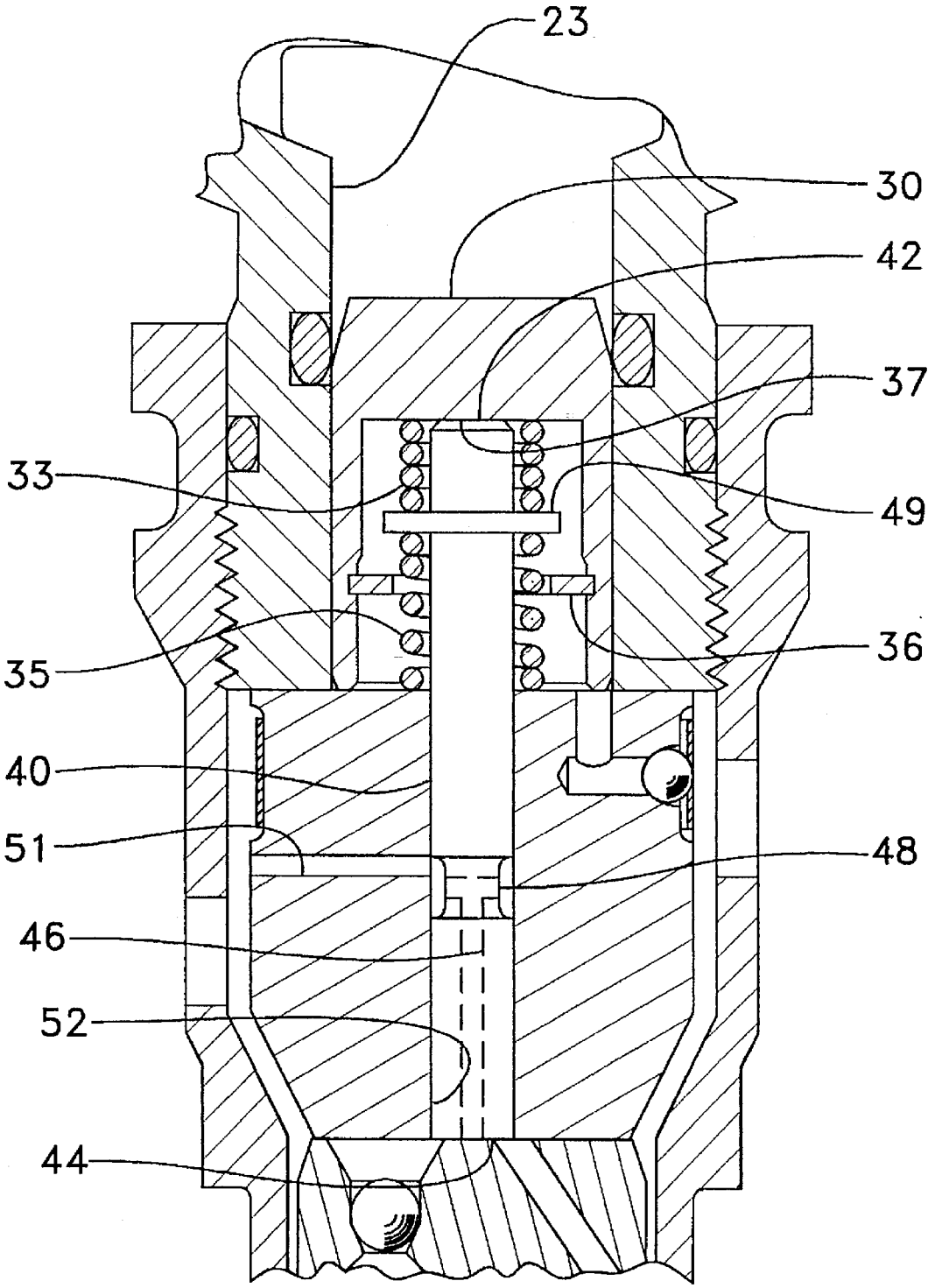
FIG. 2 is an enlarged sectioned view of the piston/plunger assembly for the injector of FIG. 1 with the rate shaping spring fully compressed.

Referring now to FIG. 2, an enlarged view of the plunger/piston assembly from the injector of FIG. 1 is shown during the injector's standby mode when fuel pressurization chamber 52 is in communication with fuel spill passageway 51 via pressure relief passage 46 and annulus 48. At this point, contact end 42 of plunger 40 is in contact with the underside 37 of piston 30 and both plunger and piston are resting at the end of their stroke. Both return spring 35 and rate shaping spring 33 act on opposite sides of an annular shoulder 49 machined on the outer surface 35 of plunger 40.

Figure 3:
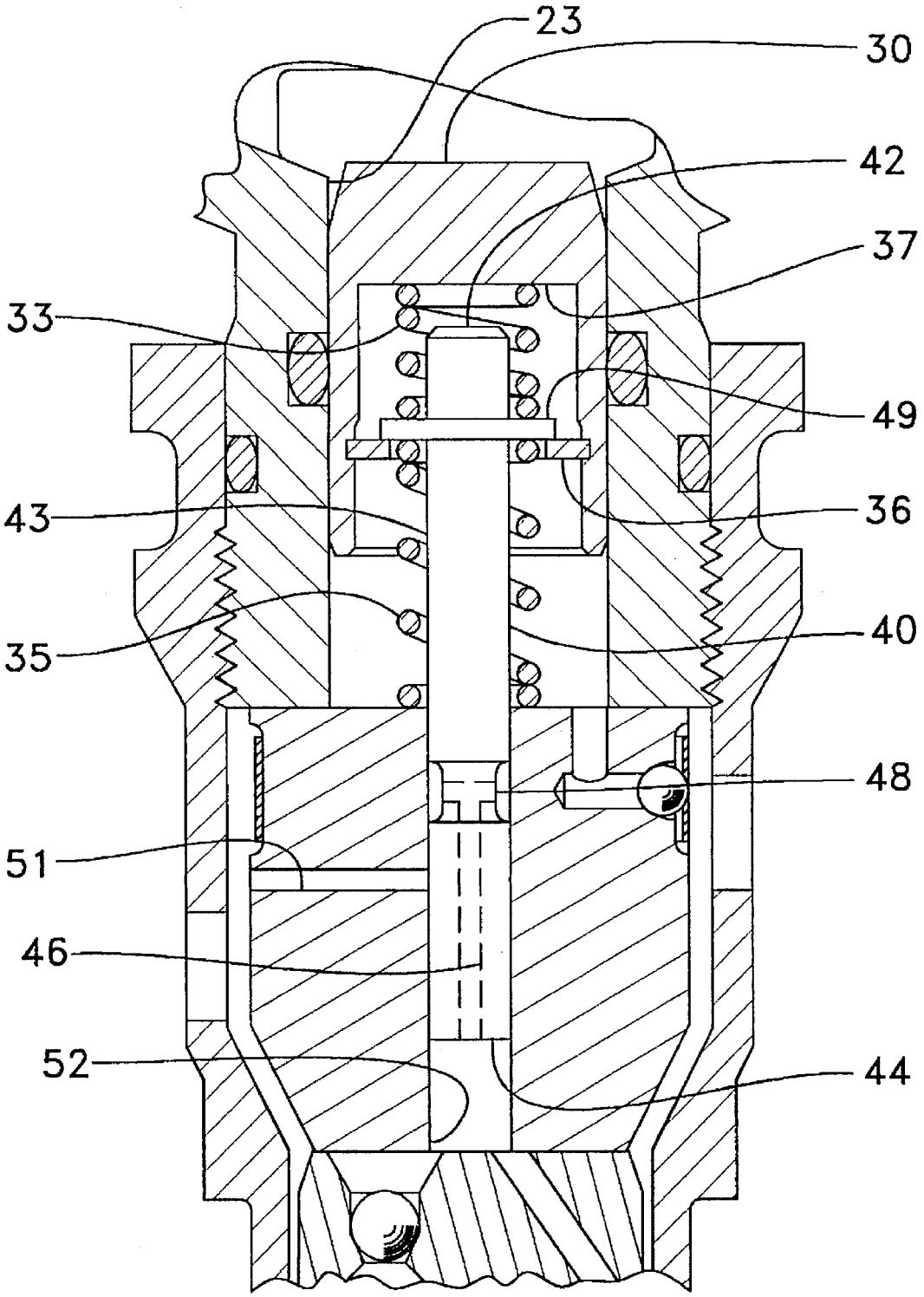
FIG. 3 is an enlarged view of the plunger/piston assembly of the fuel injector of FIG. 1 with the rate shaping spring of the present invention expanded.

When the injector is ready to begin the next injection event as shown in FIG. 3, rate shaping spring 33 has forced shoulder 49 of plunger 40 into contact with a clip ring 36 held by piston 30. The pre-injection time period is enlarged by the rate shaping spring 33 of the present invention because it slows the acceleration of plunger 40 as the piston begins its downward stroke. It should be pointed out, however, that the pre-load or assembled load of rate shaping spring 33 is preferably chosen such that pressure within fuel pressurization chamber 52 climbs above the valve opening pressure of the needle check valve before contact end 42 comes into contact with the underside 37 of piston 30. Preferably, the rate shaping spring does not even begin to yield until after plunger 40 has begun its downward stroke and the needle check has begun to open. In this way, the complete distance between plunger and piston can be utilized in enlarging the pre-injection period.

After the injection of fuel commences by the opening of the needle check, pressure continues to rise in fuel pressurization chamber 52. Eventually this pressure is high enough that rate shaping spring 33 begins to yield and plunger 40 begins moving slower than piston 30. The slower movement of plunger 40 in turn prevents the fuel pressure within fuel pressurization chamber 52 and nozzle chamber 65 from peaking. Since the mass flow rate of fuel out of nozzle outlet 58 is related to the pressure in nozzle chamber 65, those skilled in the art will appreciate that less fuel is injected than could otherwise be if there was rigid contact between plunger 40 and piston 30. At this point in time, pressure within fuel pressurization chamber 52 continues to rise, piston 30 and plunger 40 continue to accelerate in their downward motion. In a larger sense, less fuel is injected out of the injector during this brief pre-injection period because a portion of the energy in the high pressure actuation fluid acting on piston 30 is absorbed by rate shaping spring 33 rather than being transferred directly to the fuel via plunger 40.

Figure 4:
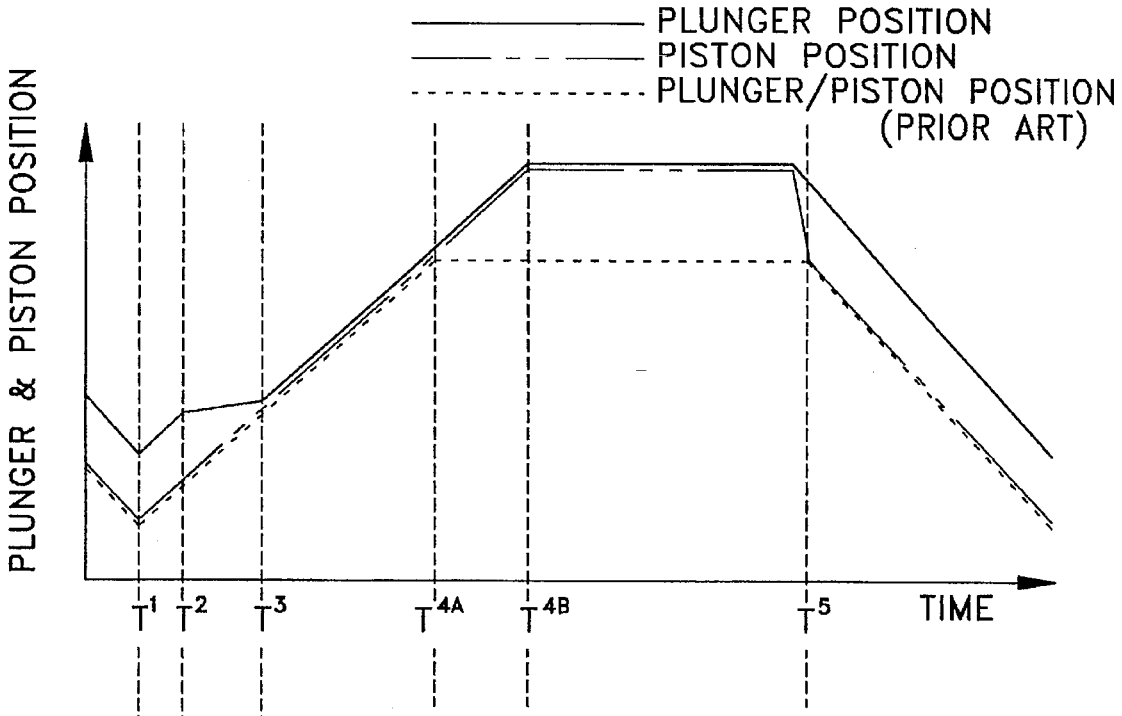
FIG. 4 is a graph of plunger and piston position versus time for a single injector cycle according to the prior art and one aspect of the present invention.

Referring now to FIG. 4, the movements of the plunger and piston are plotted versus time over a single injector cycle. FIG. 4 also shows that the rate shaping spring 33 resets itself at the beginning of each metering mode because the abrupt drop in pressure in cavity 23 at the beginning of each metering mode allows spring 33 to push shoulder 49 of plunger 40 back into contact with snap ring 36 which is held by piston 30.

Figure 5:
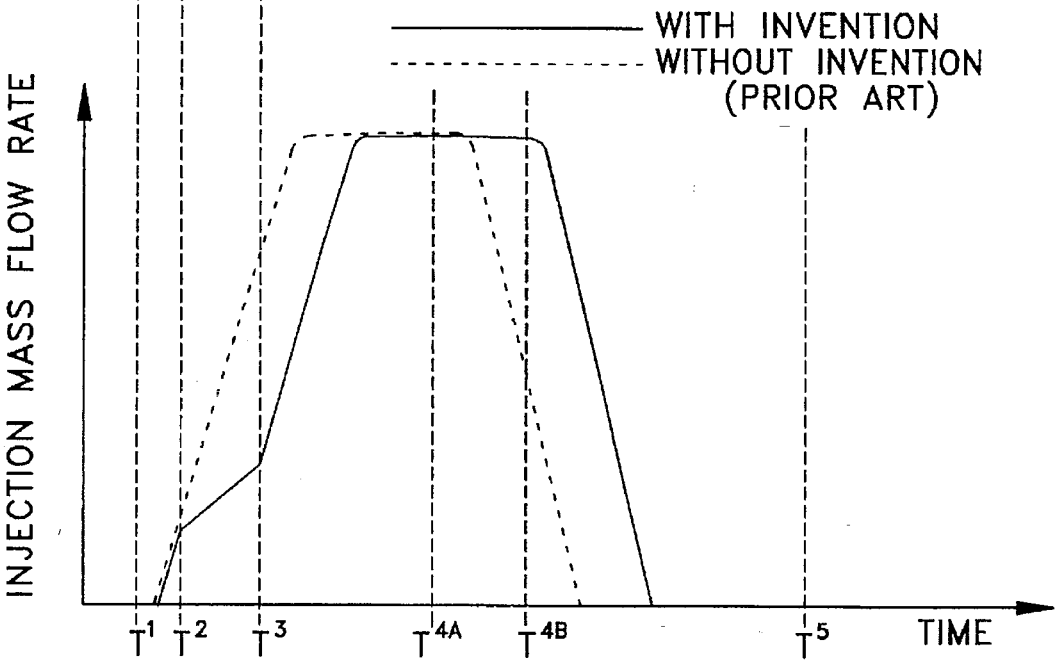
FIG. 5 is a graph of injection mass flow rate versus time for a single injector cycle with and without the rate shaping spring of the present invention.

FIG. 5 illustrates how the rate shaping spring of the present invention lowers the injection mass flow rate at the pre-injection portion of each injection event in order to improve emissions and engine performance. After rate shaping spring 33 is fully compressed, the injector begins to behave essentially like the prior art fuel injector with the piston 30 in contact with plunger 40 and both moving in unison for the remainder of their downward strokes.

For comparison purposes FIGS. 4 and 5 include a prior art plunger/piston trace along with a prior art injection mass flow rate profile, respectively, for a single injection event. It should be pointed out that the graphs of FIGS. 4 and 5 are intended to show injector performance with and without the rate shaping spring of the present invention assuming injection mass flow to be constant, but with all other factors such as timing, etc. being ignored. Those skilled in the art will appreciate that after implementing the present invention some adjustments in timing and duration should be made in order to optimize engine performance.

FIGS. 4 and 5 begin with a time period corresponding to the end of the metering mode with both plunger and piston retracting at identical rates before time T1. At time T1, the solenoid 26 is activated to allow high pressure hydraulic actuation fluid into cavity 23 to act upon the top surface 31 of piston 30 (see FIG. 1). This causes both the plunger and piston to reverse their retracting motion and begin moving in their downward strokes at identical rates. As the plunger moves downward, fuel pressure within fuel pressurization chamber 52 rises rapidly until it becomes sufficient to open needle check 60 and allow the flow of fuel from nozzle 58 to commence. Fuel begins to flow a brief time period after time T1. The rate shaping spring 33 of the present invention has not yet begun to compress. Thus the injection profile between time T1 and T2 of the present invention versus that of the prior art is identical because both the piston and plunger are moving at the same rate.

At time T2, the pressure within fuel pressurization chamber 52 reaches a second threshold which causes rate shaping spring 33 to begin to yield. This is revealed in FIG. 4 by a change in the slope of the plunger relative to that of the piston between time periods T2 and T3. Since the plunger's downward movement slows relative to the piston in this time period, the injection mass flow rate is lower than a corresponding prior art fuel injector of the same type. Eventually, at time period T3, the complete separation distance between the plunger and piston caused by rate shaping spring 33 is taken up and the plunger and piston come into direct contact and begin moving in unison after time period T3. After time period T3, the injector behaves substantially identical to its prior art equivalent since the plunger and piston are in direct rigid contact as in the prior art. Times T4A and T4B mark the time when the plungers for the prior art in the present invention reach the end of their stroke, respectively. The injector is in a standby mode between times T4A&B and T5 with the plunger and piston resting at the bottom of their stroke as shown in FIG. 2. Time period T5 illustrates the beginning of the metering mode where the plunger and piston retract and a desired amount of fuel is metered into the fuel pressurization chamber for the next injection event.

FIG. 5 shows that the end result is less fuel being injected at the beginning of each injection event. This rate shaping results in improved engine performance and a lowering of undesirable exhaust emissions, especially NOx compounds.

Industrial Applicability

The present invention is particularly applicable to a class of fuel injectors in which it is desirable to lower injection mass flow at the beginning portion of each injection event. This is particularly desirable in the case of relatively large diesel engines, such as those manufactured by Caterpillar, Inc. The concepts of the present invention are shown and illustrated with a fill metered type of hydraulically actuated electronically controlled fuel injector manufactured by Caterpillar, Inc. and described in various forms in numerous prior art patents and co-pending patent applications. Nevertheless, the rate shaping concepts of the present invention could be applied to any hydraulically actuated fuel injector that utilizes an intensifier piston and plunger assembly in order to raise fuel pressure to initiate and sustain an injection event.

Engineers can gain significant control over the injection rate shaping profile at the beginning of each injection event by varying the spring constant, the assembled pre-load on the spring and the gap distance separating the plunger from the piston. The assembled load determines when the spring will begin to yield, and the spring constant determines the rate at which it will yield. The spring pre-load is preferably chosen to be such that the needle check opens the nozzle before the spring begins to yield. In this way, none of the spring action is wasted before the injection of fuel actually commences. It is important to note that in order for the rate shaping spring to function properly, its assembled load must be such that it yields before peak fuel pressure has been achieved and preferably before peak injection mass flow has been achieved. In this way, the complete gap distance can be utilized after the injection of fuel commences but before an injection mass flow has peaked. Those skilled in the art will appreciate that the gap distance and spring constant control the duration of the spring yielding portion of the injection event. By varying these variables, the duration of the delay produced by the rate shaping spring can be controlled. For instance, a relatively large gap distance will produce a relatively extended delay duration as the plunger and piston take a relatively longer period of time to move into contact with one another against the action of the rate shaping spring.

It should be understood that the above example is intended for illustrative purposes only and is not intended to limited the scope of the present invention in any way. For instance, those skilled in the art will appreciate that, although the invention was described utilizing a rate shaping coil spring 33, other springs could be utilized, such as bellville washers or a hydraulic spring. In any event, the scope of the present invention is defined solely in terms of the claims set forth below.

I claim:

1. A hydraulically actuated fuel injector comprising:

an injector body having an actuation fluid cavity that opens to an actuation fluid inlet, an actuation fluid drain and a piston bore, and having a plunger bore that opens to a fuel supply passage and a nozzle chamber, and said nozzle chamber opens to a nozzle outlet;

a control valve mounted in said injector body and being movable between a first position that opens said actuation fluid inlet and closes said actuation fluid drain, and a second position that closes said actuation fluid inlet and opens said actuation fluid drain;

an intensifier piston positioned to reciprocate in said piston bore between an upper position and a lower position;

a plunger having a side surface extending between a contact end and a pressure face end being positioned to reciprocate in said plunger bore between an advanced position and a retracted position;

means, positioned between said intensifier piston and said plunger, for biasing said intensifier piston a distance away from said plunger;

a portion of said plunger bore and said plunger defining a fuel pressurization chamber that opens to said nozzle chamber; and a needle check positioned to reciprocate in said nozzle chamber between a closed position that closes said nozzle outlet and an open position that opens said nozzle outlet.

2. The fuel injector of claim 1 wherein said means for biasing said intensifier piston includes a compression spring.

3. The fuel injector of claim 2 wherein said compression spring is a coil spring.

4. The fuel injector of claim 3 wherein coil spring is compressible such that said contact end of said plunger contacts said intensifier piston when said intensifier piston is moving from said upper position toward said lower position.

5. The fuel injector of claim 4 wherein said needle check has a valve opening pressure;

said fuel pressurization chamber has a threshold fuel pressure sufficient to move said plunger toward contact with said intensifier piston; and said threshold fuel pressure is greater than said valve opening pressure.

6. The fuel injector of claim 5 further comprising means for stopping said plunger at a metered position between said retracted position and said advanced position when said plunger is retracting from said advanced position.

7. A hydraulically actuated fuel injector comprising:

an injector body having an actuation fluid cavity that opens to an actuation fluid inlet, an actuation fluid drain and a piston bore, and having a plunger bore that opens to a fuel supply passage and a nozzle chamber, and said nozzle chamber opens to a nozzle outlet;

a control valve mounted in said injector body and being movable between a first position that opens said actuation fluid inlet and closes said actuation fluid drain, and a second position that closes said actuation fluid inlet and opens said actuation fluid drain;

an intensifier piston positioned to reciprocate in said piston bore between an upper position and a lower position;

a plunger having a side surface extending between a contact end and a pressure face end being positioned to reciprocate in said plunger bore between an advanced position and a retracted position;

means, positioned between said intensifier piston and said plunger, for causing relative motion between said intensifier piston and said plunger when said plunger is moving from said retracted position toward said advanced position;

a portion of said plunger bore and said plunger defining a fuel pressurization chamber that opens to said nozzle chamber; and a needle check positioned to reciprocate in said nozzle chamber between a closed position that closes said nozzle outlet and an open position that opens said nozzle outlet.

8. The fuel injector of claim 7 wherein said means for causing includes a spring positioned between said intensifier piston and said plunger.

9. The fuel injector of claim 8 wherein said needle check has a valve opening pressure;

said fuel pressurization chamber has a threshold fuel pressure sufficient to move said plunger toward contact with said intensifier piston; and said threshold fuel pressure is greater than said valve opening pressure.

* * * * *